United States Patent [19]

Terry

[11] 3,996,825

[45] Dec. 14, 1976

[54] METHOD AND APPARATUS FOR CUTTING A WEB FIBROUS NON-WOVEN MAT

[75] Inventor: Rupert Douglas Terry, Toledo, Ohio

[73] Assignee: Johns-Manville Corporation, Denver, Colo.

[22] Filed: Dec. 18, 1975

[21] Appl. No.: 642,093

[52] U.S. Cl. ..... 83/53; 83/177

[51] Int. Cl.[2] ..... B26F 3/00

[58] Field of Search ..... 83/53, 177

[56] References Cited

UNITED STATES PATENTS

| | | | |
|---|---|---|---|
| 2,587,243 | 2/1952 | Sweetman | 83/53 |
| 3,526,162 | 9/1970 | Willcox | 83/53 |
| 3,532,014 | 10/1970 | Franz | 83/53 |

*Primary Examiner*—Donald R. Schran
*Attorney, Agent, or Firm*—Robert M. Krone; Joseph J. Kelly; John H. Miller

[57] ABSTRACT

Previous attempts to cut or trim a wet, non-woven, fibrous mat using a fluid jet have been largely unsuccessful, particularly when the mat contained reinforcing strands. The present invention overcomes this problem by using a fluid jet located below the mat in combination with a fluid jet set at an angle above the mat.

12 Claims, 3 Drawing Figures

110
106
108
134
112
118
120
124
62
132
102
114
70
76
100
66
68
74
42
72
52
12
56
44

METHOD AND APPARATUS FOR CUTTING A WEB FIBROUS NON-WOVEN MAT

BACKGROUND OF THE INVENTION

Methods and apparatus for making a non-woven mat continuously from fibers, particularly inorganic fibers such as glass fibers, from fiber containing slurries are well known in the art. For example British Patent Specification No. 1,376,130 discloses a typical system used to make non-woven mats continuously from a fiber containing slurry. It is also known to make reinforced mats containing reinforcing strands comprising a plurality of monofilament fibers bonded together with an insoluble binder as evidenced by the German Offenlegungsschrift 2,354,553 and United States Application Serial No. 518,332, filed Oct. 29, 1974. In these processes the fibrous slurry is distributed over a moving foraminous surface such as a moving mesh belt and the water is sucked through the foraminous surface depositing the fibers in a random manner in a thin layer on the belt to form a mat.

In the systems described above the foraminous surface is typically 10 to 12 feet or more in width to accommodate the maximum width requirements of the finished product. Since the capital expenditure for such a system and the capacity of the system are both quite high, requirements for narrower mats are met by cutting the finished product lengthwise to produce the width desired. Unfortunately, the products on order rarely can be combined in such a manner as to use the full width or essentially the full width being produced on the machine. This means that a surplus strip of material is usually produced which, because of its varying and small widths, cannot be sold. The finished product contains a binder which has been cured in the oven to bond the fibers together in the mat and therefore the surplus strip of mat cannot be recycled back through the system.

Attempts have been made in the past to slit or cut the wet non-woven mat on the foraminous surface before a binder is added and cured, but the results have been unsatisfactory. Whereas the final product can be slit with a rotating knife after having been lifted from a conveyor coming from the drying and curing oven, the wet mat coming off of the formaminous surface is very fragile and pliable and therefore not susceptible to cutting in the same manner as the finished product. The wet mat cannot be cut on the foraminous surface because the foraminous surface is usually a mesh belt made from a plastic material which would be damaged in cutting the mat.

One attempt that has been tried for cutting the mat on the foraminous surface is to mount a jet or nozzle above the mat and direct a high pressure stream of fluid such as water onto the mat to attempt to separate or cut the mat by eroding the fibers away continuously from a specific area of the moving mat. This resulted in forcing the fibers into and through the perforations in the foraminous surface, an unsatisfactory result. The erosion of the fibers was also incomplete, particularly when the mat contained reinforcing fiber strands, and this caused problems when attempts were made to separate the trimmed portion from the main portion of the mat.

The purpose of the present invention is to provide a method and apparatus for overcoming the above problems and for cleanly and economically separating a linear portion of the wet non-woven mat continuously from along one or both edges so that the non-wanted trim can be returned or recycled back as raw material to the mat forming system.

BRIEF SUMMARY OF THE INVENTION

The present invention provides an apparatus for continuously cutting or separating a moving non-woven fibrous mat resting on a foraminous surface, comprising a source of high pressure fluid and a first nozzle communicating with the source, the nozzle being located above and spaced from the mat, the nozzle being positioned to direct a stream of fluid onto the mat at the desired area of separation, the improvement comprising: means located below the foraminous surface for directing a stream of fluid at high velocity upwardly into the area of separation, the first nozzle being positioned at an angle from the vertical and such that a fluid emitted from the first nozzle would be directed away from a longitudinal centerline of the mat. The apparatus preferably utilizes a second nozzle as the means for directing a stream of fluid upwardly at high velocity and the first and second nozzles are positiond such that their centerlines intersect at a point spaced above the foraminous surface, preferably ⅛ to ½ inch above the foraminous surface. Also, preferably the first and second nozzles are located on a common manifold that supplies the nozzles with a fluid at high pressure and which can be readily moved to adjust the width of the trim.

The present invention also provides a method for continuously cutting or separating a moving non-woven fibrous mat resting on a moving foraminous surface by directing a stream of high velocity fluid onto the mat from above the mat, wherein the improvement comprises directing the stream coming from above the mat in a direction away from a longitudinal centerline of the mat and at the same time directing a stream of fluid at high velocity vertically upwardly from below the foraminous surface and into the same area into which the upper stream is directed. Preferably the centerline of the upper stream and that of the lower stream intersect at a point located about ⅛ to about ½ inch above the foraminous surface.

DETAILED DESCRIPTION AND PREFERRED EMBODIMENTS

Figure 1:
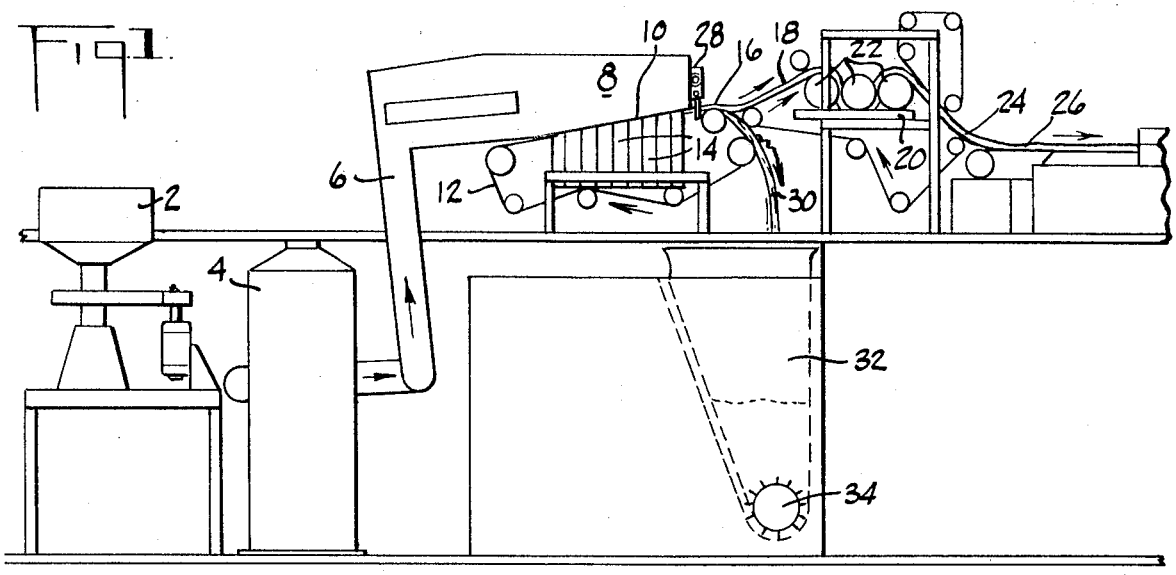
FIG. 1 is a vertical section elevation of a portion of a system in which the present invention is used.

FIG. 1 is a vertical section elevation of part of a system for producing a fibrous mat from an aqueous fibrous slurry. In this system a fibrous aqueous slurry, such as a suspension of glass fibers in water, is prepared in a mixer 2 and pumped to a holding tank 4 through a pipe (not shown). This slurry is then pumped under high pressure via pipe 6 to a hydroformer 8 where the slurry is spread out in a layer over a foraminous surface 10, such as a sieve-like conveyor belt 12. Suction is supplied to the slurry by the suction tubes 14, which sucks the water through the belt 12 leaving a mat 16 of randomly interlocked fibers on the upper surface of moving belt 12. The water sucked into the tubes 14 by a vacuum source (not shown) is piped to a conventional holding tank by conventional piping (not shown) for use in the mixer 2 to make new slurry.

The wet fibrous mat 16 is transferred from the first moving belt 12 onto a second belt 18 which can be identical in material and construction as the belt 12. The belt 18 and mat 16, moving in the direction shown by the arrows is passed through a resin bath 20 by a set of rollers 22 where the mat 16 is saturated with a binder resin. The binder saturated mat 24 is transferred from the conveyor 18 to a third conveyor 26. The conveyor 26 carries the binder saturated mat 24 through a mat dryer where any remaining moisture in the mat and binder are removed and the resin in the binder is cured.

After leaving the dryer the cured mat is wound up in a conventional manner on conventional equipment (not shown) and is ready for shipment. Before winding a small portion of the edge, which usually is somewhat fuzzy, is trimmed with a rotating blade to produce a nice straight edge. Curing of the binder in the mat renders the binder insoluble and thus it is not possible to return the trim back to the slurry mixing tank 2 for recycling. Normally the trim is discarded as scrap.

A typical width of the wet mat 16 is in the range of 10 to 12 feet and it is impractical if not virtually impossible to reduce this width in the hydroformer 8. Thus, when the total width of the products being manufactured do not approach the width of the wet mat 16, the scrap loss is substantial and seriously affects the economics of this system, particularly when making a mat from relatively expensive fibers.

To overcome this problem the present invention permits the wet mat 16 to be trimmed after leaving the hydroformer 8 and before the mat is transferred to the second conveyor 78. This trimming is accomplished by a trimming apparatus 28 of the present invention. One or both edges can be trimmed by the use of one or two of the trimming devices 28. An edge trim 30 which is separated from the main portion of the mat 16 by the trimming device 28 is not transferred to the second conveyor 18, but instead is directed to a scrap return hopper 32 where it is disintegrated by a pump 34 and pumped back the slurry holding tank 4 by conventional piping (not shown). In slurry holding tank 4 by conventional piping (not shown). In the past, the scrap return hopper 32 and pump 34 have been used to recycle the entire mat 16 during the startup or during periods when the quality of the mat 16 was off standard for some reason. Having removed the edge trim 30 while in the wet state, and before a binder is added and cured, the trim is recyclable. The finished mat product requires, at most, only a very narrow edge trim merely to provide a sharp and uniform edge.

Figure 2:
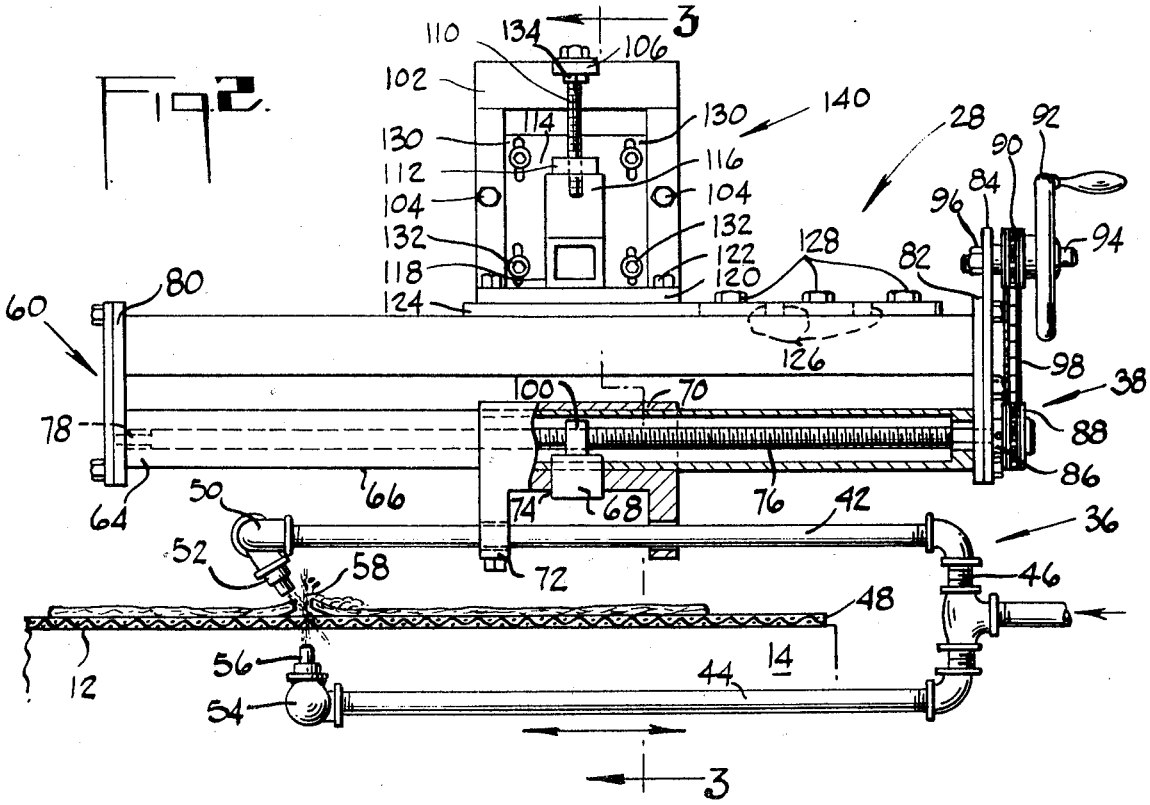
FIG. 2 is a front view, partially broken away, of a preferred embodiment of the apparatus of the present invention.

Referring to FIG. 2, the trimming apparatus 28 of the present invention comprises a manifold assembly 36, a nozzle positioning assembly 38, and a mounting assembly 40. The manifold assembly 36 is normally a U-shaped manifold having one leg 42 extending over the foraminous surface or conveyor belt 12, one leg 44 extending below the belt 12, and a connecting portion 46 connecting the two legs 42 and 44 and being adjacent to an edge 48 of the belt 12. The manifold in the embodiment shown in FIG. 2 is made from conventional pipe and pipe fittings, but could be of any conventional manufacture.

At the end of the upper leg 42 is a fitting 50 which holds a nozzle 52 in such a manner that the centerline of the nozzle is at an angle with respect to the vertical. Various angles can be used, but a suitable angle is typically about 45° from the vertical, and the nozzle is so oriented that the stream it emits is directly downwardly and towards the edge 48 of the belt 12. The lower leg 44 has at its end a fitting 54 which holds a nozzle 56 in such a manner that the centerline of the stream it emits is essentially vertical.

The nozzles 52 and 56 can be identical and preferably contain a round hole, typically about 9/64 of an inch in diameter, through which the fluid stream is emitted. The manifold is so constructed and the nozzles are so located to place the centerlines of the two streams emitted by the nozzles 52 and 56 so that the centerlines intersect at a point 58, which point is above the top surface of the belt 12 and preferably about ¼ to ½ inch above the top surface of the belt 12.

The only essential elements of the apparatus of the present invention are the means for maintaining the nozzles 52 and 56 in the positions described above and means for feeding a high pressure fluid to these nozzles. The nozzle adjusting assembly 38 and the mounting assembly 40 are merely optional features in a preferred embodiment.

The manifold assembly 36 is connected to a source of high pressure fluid, which comprises conventional well known equipment, e.g. a city water line, a high pressure pump connected to a fluid source, etc. A typical suitable pressure is 25 psig. This system also preferably comprises a conventional pressure regulator which allows the pressure in the manifold assembly 36 to be adjusted to a desired level. In the preferred embodiment, the fluid used to supply the manifold assembly 36 is withdrawn from the scrap return container 32, filtered to remove any solid material including fibers that would tend to disrupt the flow through the nozzles 52 and 56, and fed by a conventional high pressure pump through a conventional pressure regulator to the manifold 36.

Figure 3:
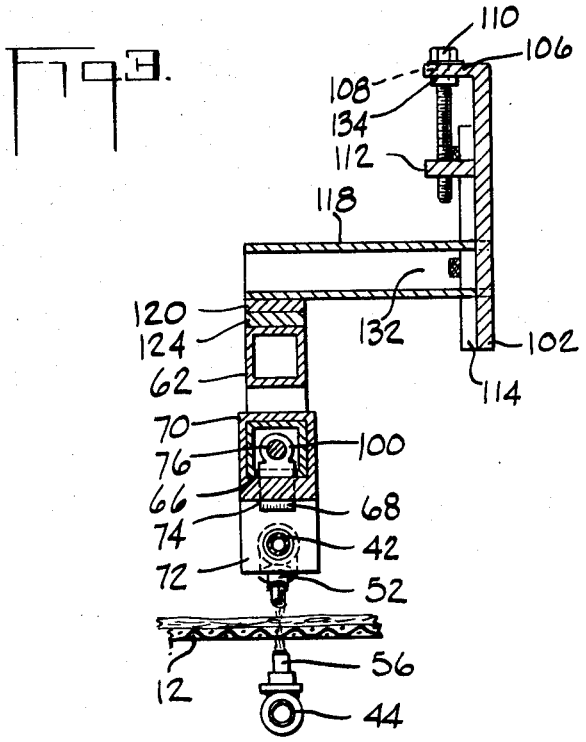
FIG. 3 is an end view of the apparatus shown in FIG. 2.

In the preferred embodiment the manifold assembly is moved to the desired position and maintained in the proper position by a nozzle adjusting assembly 38. The nozzle adjusting assembly comprises a main frame 60 made up of an upper frame member 62 and a lower frame member 64. The lower frame member 64 is a box channel having a slot 65 in the lower surface 66 to accommodate a horizontal movement of a nut follower 68. A saddle member 70 surrounds the channel 64 and grips the upper member 42 of the manifold assembly 36 with a conventional clamp assembly 72, best shown in FIG. 3.

The saddle member 70 has a slot 74 in its lower surface to accommodate the nut follower 68. A threaded shaft 76 is located in the center portion of the box channel 64 and runs completely along its length. The threaded shaft 76 is supported on one extremity by extending into a hole 78 in a plate 80, which is part of the main frame 60. The other end of the shaft 76 extends through holes in plates 82 and 84, which are parts of the main frame 60, and is supported in a bearing 86 attached to the plate 84. The shaft 76 extends through the bearing 86 sufficient to support a sprocket 88. A second sprocket 90, preferably smaller in diameter than the sprocket 88, is attached to a hand wheel 92, both of which are supported by a conventional bushing (not shown) and a shaft 94 mounted on the plate 84 with a nut 96. Rotation of the hand crank 92 rotates the sprocket 90 and, through a chain 98, also rotates the sprocket 88 and the shaft 76.

A nut 100 is threaded onto the threaded shaft 76 and is attached to the nut follower 68. Rotation of the shaft 76 causes the nut 100 and the nut follower 68 to move laterally along the shaft 76 in a direction dependent upon the direction of rotation of the shaft 76. As the nut follower 68 moves laterally, it pushes the saddle 70 laterally which in turn positions the nozzles 52 and 56 with respect to the edge 48 of the belt 12. A lubricant can be applied to the top and sides of the channel member 64 to enhance the sliding relationship between the channel 64 and the saddle 70.

The manifold assembly 36 and the nozzle adjusting assembly 38 are held in position by the mounting assembly 40. The mounting assembly 40 comprises a mounting plate 102 which can be attached by any suitable means to any suitable frame, or preferably to the front of the hydroformer 8 as shown in FIG. 1. The plate 102 can be mounted by welding or by bolts 104. Rigidly attached to the center portion of the top of the plate 102 is an arm 106 containing a hole 108 therethrough large enough to permit a threaded bolt 110 to be passed through the hole and to be rotated without binding.

The bolt 110 is threaded into an ear or arm 112 which is rigidly attached to the top center portion of a plate 114 having a large cutout 116. The cutout 116 provides space for the bottom end of the bolt 110 and for an end portion of a mounting arm 118. Welded to the plate 114 in a perpendicular relationship is the mounting arm 118, which can be a box channel.

The other end of the mounting arm 118 is rigidly attached to a first plate 120. Bolted to the plate 120 by bolts 122 is a second plate 124 having three longitudinal slots 126 in its extended end. The second plate 124 is bolted to the upper frame member 62, preferably with three bolts 128. The slots 126 permit the manifold assembly 36 and the nozzle adjusting assembly 38 to be slightly adjusted transversely of the belt 12 to account for any mounting errors. When the nozzle adjusting assembly 38 is in the proper position, the bolts 128 are tightened down locking the nozzle adjusting assembly in a fixed position transversely of the belt 12.

The plate 114 is held in place by the bolt 110 and by bolts 132 passing through slots 130 in the plate 114 and threaded into the plate 102. To correct for any mounting errors in the vertical position of the nozzle adjusting assembly 38 and the manifold assembly 36, the bolts 132 are loosened, and the plate 114, containing the vertical slots 130 having a length long enough to permit a ½ inch vertical adjustment, is adjusted to the proper vertical position by turning the bolt 110 in the proper direction to properly position the nozzles 56 and 52 with respect to the belt 12. When the nozzles 52 and 56 are in the proper position the bolts 132 are tightened and a nut 134 is tightened against the bottom of the arm 106 to prevent the plate 112 from moving upwardly.

In describing the invention certain embodiments have been used to illustrate the invention and the practice thereof. However, the invention is not limited to these specific embodiments as other embodiments and modifications within the spirit of the invention will readily occur to those skilled in the art on reading this specification. The invention is thus not intended to be limited to the specific embodiments disclosed, but instead is to be limited only by the claims appended hereto.

What I claim is:

1. In an apparatus for continuously cutting or separating a moving non-woven fibrous mat resting on a foraminous surface comprising a source of high pressure fluid and a first nozzle communicating with said source, said nozzle being located above and spaced from said mat, the nozzle being positioned to direct a stream of fluid onto the mat at the desired area of separation, the improvement comprising:

means located below said foraminous surface for directing a stream of fluid at a high velocity upwardly into the area of separation, said first nozzle being positioned at an angle from the vertical and such that a fluid emitted from the first nozzle would be directed away from a longitudinal centerline of the mat.

2. An apparatus as defined in claim 1 wherein said means is a second nozzle which also communicates with said source of high pressure fluid, the first and second nozzles being positioned such that their centerlines intersect at a point spaced above the foraminous surface.

3. An apparatus as defined in claim 2 wherein the upper nozzle and said second nozzle communicate with said source of high pressure fluid through a common manifold, the manifold extending over a portion of the foraminous surface, downward adjacent a longitudinal edge of the foraminous surface, and beneath a portion of the foraminous surface.

4. An apparatus as defined in claim 3 wherein said manifold is movable to adjust the upper nozzle and the second nozzle at various distances from the longitudinal edge of said foraminous surface.

5. An apparatus as defined in claim 2 wherein said centerlines intersect at a point located from about ⅛ to about ½ inch above said foraminous surface.

6. An apparatus as defined in claim 4 including means for moving said manifold to locate the upper nozzle and the second nozzle at various distances from the longitudinal edge of said foraminous surface.

7. A method for cutting or separating a moving non-woven fibrous mat resting on a foraminous surface comprising directing a jet of fluid onto said mat in the area of the desired separation from above said mat, the improvement comprising: simultaneously directing a second jet of fluid upwardly from below said foraminous surface and into the area of separation, the first jet being positioned at an angle from the vertical and such that the jet is directed away from a longitudinal centerline of the mat.

8. A method as defined in claim 7 wherein the first and second jets are positioned such that their centerlines intersect at a point spaced above the foraminous surface.

9. A method as defined in claim 8 wherein said point is located from about ⅛ inch to about ½ inch above said foraminous surface.

10. A method as defined in claim 9 wherein said fluid is an aqueous liquid.

11. A method as defined in claim 10 wherein said fibrous mat comprises glass fibers.

12. A method as defined in claim 10 wherein said fibrous mat comprises monofilament glass fibers and reinforcing strands comprising a plurality of monofilament glass fibers bonded together with a binder insoluble in said aqueous liquid.

* * * * *